US005154209A

United States Patent [19]

Takegawa

[11] Patent Number: 5,154,209

[45] Date of Patent: Oct. 13, 1992

[54] POSITIVE FEED PICKING DEVICE FOR A FLUID JET LOOM

[75] Inventor: Yujiro Takegawa, Kahoku, Japan

[73] Assignee: Tsudakoma Corp., Ishikawa, Japan

[21] Appl. No.: 765,038

[22] Filed: Sep. 24, 1991

[30] Foreign Application Priority Data

Sep. 27, 1990 [JP] Japan ..... 2-258312

[51] Int. Cl.[5] ..... D03D 47/30

[52] U.S. Cl. ..... 139/452; 242/47.01

[58] Field of Search ..... 139/452; 242/47.01

[56] References Cited

U.S. PATENT DOCUMENTS 5,010,834 4/1991 Iimuoro et al. ..... 139/452

FOREIGN PATENT DOCUMENTS 3714826 6/1988 Fed. Rep. of Germany ..... 139/452

51-58563 5/1976 Japan .

*Primary Examiner*—Andrew M. Falik

*Attorney, Agent, or Firm*—Wenderoth, Lind & Ponack

[57] ABSTRACT

A positive feed picking device for a fluid jet loom includes a yarn measuring and storing device; a main picking nozzle; a positive feed mechanism including a drive roller and a motor for driving the drive roller. The positive feed mechanism is disposed between the yarn measuring and storing device and the main picking nozzle to feed a weft yarn positively to the main picking nozzle during a picking period. The feed picking device also includes a sensor disposed on a yarn path along which the weft yarn travels for detecting the delivery of a predetermined length of the weft yarn from the yarn measuring and storing device. A motor controller for controlling the operating speed of the motor of the positive feed mechanism, and a controller for controlling the positive feed mechanism are also included in the positive feed picking device. The controller starts the positive feed mechanism at the start of picking period. The motor controller controls the motor so that the rotating speed of the motor varies according to a predetermined speed control characteristic.

3 Claims, 2 Drawing Sheets

POSITIVE FEED PICKING DEVICE FOR A FLUID JET LOOM

BACKGROUND OF THE INVENTION

1. Field of the Invention

The present invention relates to a picking device for a fluid jet loom and, more particularly, to a positive feed picking device provided with a positive feed mechanism for positively feeding a weft yarn for picking.

2. Description of the Prior Art

The main picking nozzle of a fluid jet loom needs to pick a weft yarn against a resistance against pulling out the weft yarn from a yarn measuring and storing device.

An invention intended to reduce the load on the main picking nozzle of a fluid jet loom is disclosed in Japanese laid-open patent application (Kokai) No. Sho 51-58563. According to this invention, a weft yarn is fed positively by a pair of rollers comprised of a movable roller and a fixed roller that rotates continuously during a picking cycle. The pair of rollers nip the weft yarn therebetween during a picking period and the movable roller separates from the other roller to stop feeding the weft yarn upon the completion of a picking operation. Although nothing concrete is mentioned in the invention about controlling the timing of separating the movable roller from the fixed roller, the time for separating the movable roller from the fixed roller can be determined on the basis of the angular position of the main shaft of the fluid jet loom because the movable roller is brought into contact with the fixed roller when the main shaft is at a picking starting angle. When the pair of rollers are controlled in such a manner, the rollers are unable to feed a set length of weft yarn and an insufficient length of weft yarn is fed if the rollers slip relative to each other, which reduces the rotational energy utilization efficiency.

If the time for separating the movable roller from the fixed roller is delayed, an excessive length of weft yarn is fed, thereby increasing the tension in a portion of the weft yarn extending between the yarn measuring and storing device and the pair of rollers, which is liable to cause yarn breakage.

SUMMARY OF THE INVENTION

Accordingly, it is an object of the present invention to enable yarn feeding operation at a high efficiency without entailing yarn breakage by accurately synchronizing the operation of a positive feed mechanism and the picking operation of a loom.

Another object of the present invention is to further improve the efficiency of positive yarn feed operation by synchronizing the yarn feed operation of a positive feed mechanism and the weaving operation of a loom.

To achieve objects, the positive feed picking device according to the present invention disposes a positive feed mechanism provided with rollers between a yarn measuring and storing device and a main picking nozzle, detects the length of weft yarn delivered from the yarn measuring and storing device by a sensor, and controls a motor controller by a controller to stop the positive feed mechanism upon the reception of a detection signal provided by the sensor upon the detection of a predetermined length of weft yarn delivered from the yarn measuring and storing device by the controller.

The controller actuates the positive feed mechanism upon the start of the main picking nozzle for a picking operation to feed the weft yarn positively to the main picking nozzle. The sensor provides a detection signal to the controller upon the detection of the feed of a predetermined length of weft yarn. Then, the controller stops the positive feed mechanism to set the weft yarn free. The motor controller controls the surface speed of the roller while the positive feed mechanism is in operation according to a speed control characteristic represented by, for example, an upward convex curve to suppress the sharp variation of the yarn tension so that yarn breakage is prevented and the rotation transmission efficiency of the rollers is enhanced.

DESCRIPTION OF THE PREFERRED EMBODIMENTS

Figure 1:
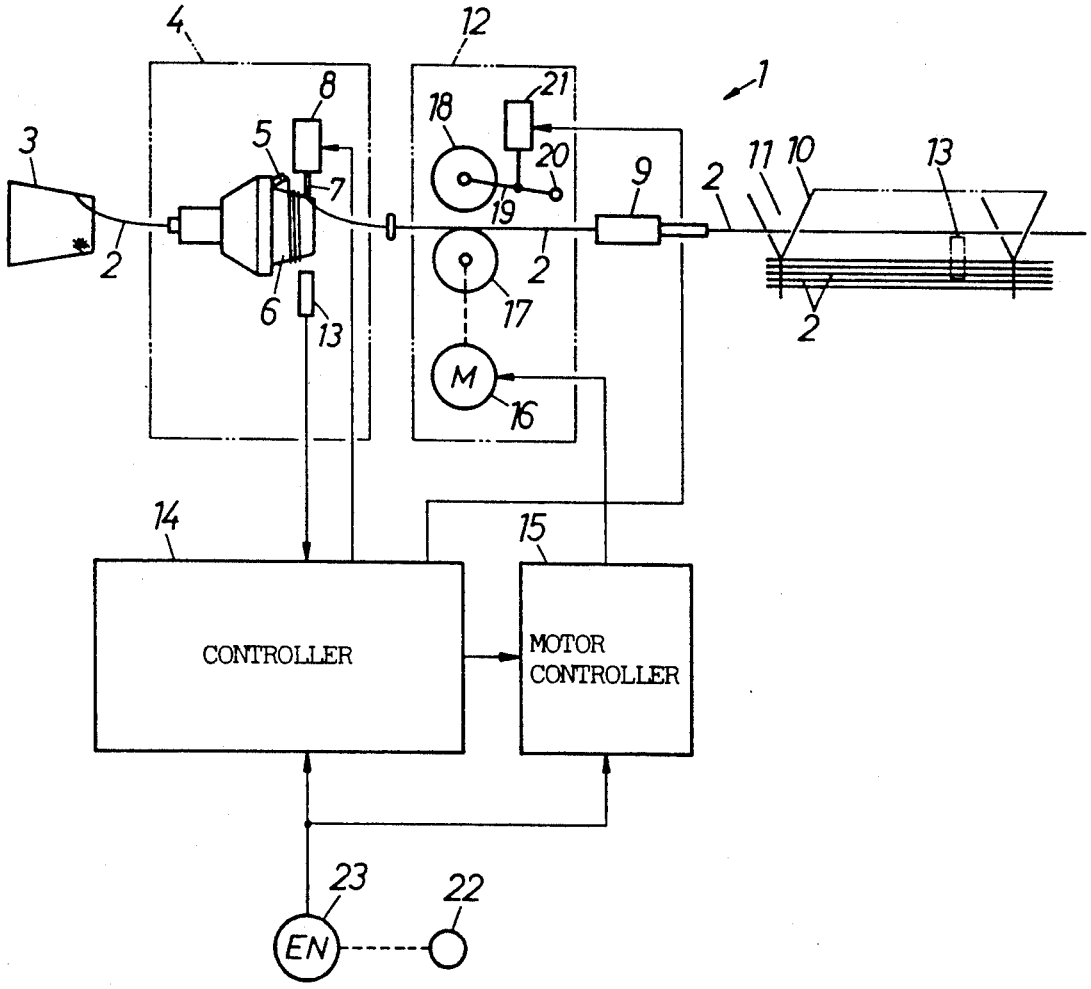
FIG. 1 is a block diagram of a positive feed picking device for a fluid jet loom.
Figure 3:
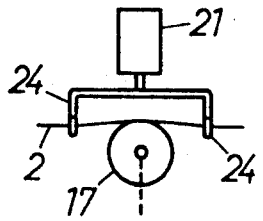
FIG. 3 is a fragmentary schematic view of a modification of a positive feed mechanism included in the positive feed picking device of FIG. 1.

Referring to FIG. 1 showing the general construction of a positive feed picking device 1 for a fluid jet loom, in a preferred embodiment according to the present invention, a weft yarn 2 unwound from a yarn package 3 is measured by, for example, a yarn measuring and storing device 4 of a fixed drum type and a predetermined length of the weft yarn 2 for one picking cycle, for example, a length corresponding to four coils on the yarn storage drum 6 of the yarn measuring and storing device 4, is stored on the yarn storage drum 6. In storing the weft yarn 2 on the yarn storage drum 6, the weft yarn 2 is held on the yarn storage drum 6 with a holding pin 7 and a rotary yarn guide 5 revolves around the yarn storage drum 6 to wind the weft yarn 2 around the yarn storage drum 6 in a predetermined number of coils.

At the start of the picking period, the holding pin 7 is retracted by a pin operating device 8 to allow the weft yarn 2 stored on the yarn storage drum 6 to be unwound from the yarn storage drum 6 and to be picked into a shed 11 formed by warp yarns 10 by a fluid jetted by a main picking nozzle 9.

The positive feed picking device 1 comprises, as principal components, a positive feed mechanism 12, a sensor 13, a controller 14 and a motor controller 15. The positive feed mechanism 12 is disposed between the yarn measuring and storing device 4 and the main picking nozzle 9 and comprises a drive roller 17, a servomotor 16 for driving the drive roller 17, a movable driven roller 18 capable of being brought into contact with the drive roller 17, and a lever 19 supporting the driven roller 18. The lever 19 has one end pivotally supported on a shaft 20 at a fixed position and the other end supporting the driven roller 18. The lever 20 is turned on the shaft 20 by, for example, an electromagnetic actuator 21 between a position where the driven roller 18 is separated from the drive roller 17 and a position where the driven roller 18 is in contact with the drive roller 17 to feed the weft yarn 2.

The sensor 13 may be disposed at a position between a position where the weft yarn 2 is unwound from the yarn storage drum 6 and a position immediately before an exit of the shed 11 on a yarn passage. In this embodiment, the sensor 13 is disposed close to the circumference of the yarn storage drum 6 and near the holding pin 7 to detect the number of coils of weft yarn unwound from the yarn storage drum 6.

The controller 14 receives an angular position signal indicating an angular position of the main shaft 22 of the loom provided by a rotary encoder 23 and a length signal provided by the sensor 13, and controls the pin operating device 8, the electromagnetic actuator 21 and the motor controller 15. The motor controller 15 is provided with a program and a table containing the surface speed of the drive roller 17 in relation with the angular position of the main shaft 22. The motor controller 15 provides a command signal on the basis of an angular position signal indicating an angular position of the main shaft 22 provided by the rotary encoder 23 to control the operating speed of the servomotor 16.

While the loom is in operation, the yarn measuring and storing device 4 stores four coils of weft yarn 2 on the yarn storage drum 6 for each picking cycle.

Figure 2:
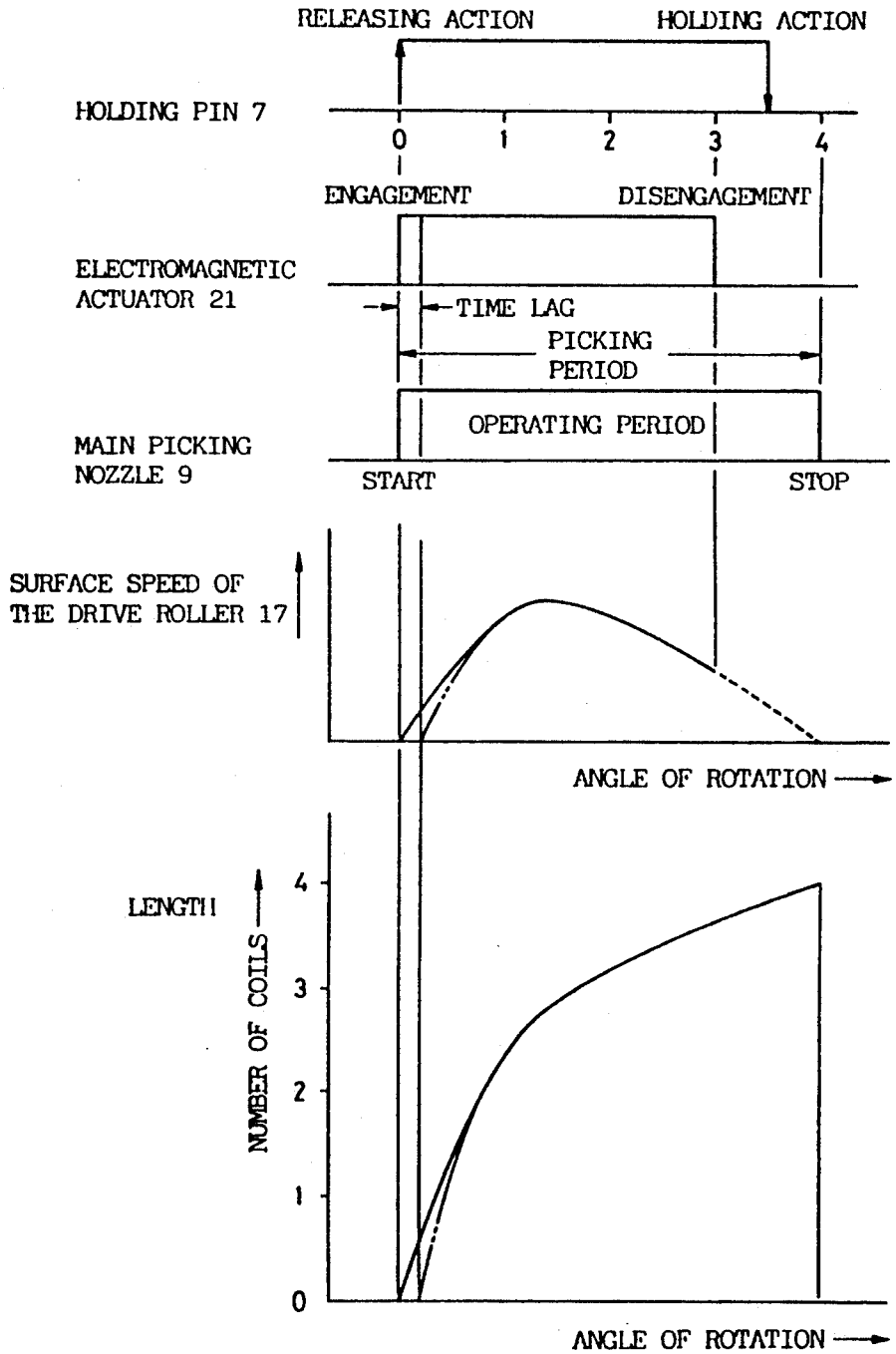
FIG. 2 includes five waveforms which are of assistance in explaining the operating characteristics of the positive feed picking device of FIG. 1.

Referring to FIG. 2 the first three waveforms respectively illustrate the operation of the holding pin, electromagnetic actuator, and main picking nozzle of the device of FIG. 1 while the fourth and fifth waveforms respectively illustrate the surface speed of the drive roller and the number of stored yarn coils of the device of FIG. 1 versus the angle of rotation of the drum of the device of FIG. 1. With the main shaft 22 at an angular position for picking, the controller 14 drives the pin operating device 8 to release the weft yarn 2 stored on the yarn storage drum 6 by retracting the holding pin 7. At the same time or after a predetermined time lag, the controller 14 provides a command signal to the motor controller 15 and drives the electromagnetic actuator 21 so that the driven roller 18 is brought into contact with the drive roller 17 to nip the weft yarn 2 therebetween.

The motor controller 15 provides a driving signal to drive the servomotor 16 so that the drive roller 17 is driven for rotation at a surface speed corresponding to the angular position of the main shaft 22 of the loom according to a speed control characteristic represented by the upward convex curve shown in FIG. 2. According to the speed control characteristic, the surface speed of the drive roller 17 increases sharply with time after the picking period has started, reaches a maximum in a time in which one or two coils of the weft yarn 2 is unwound from the yarn storage drum 6, and then decreases gradually with time.

During the picking period, the main picking nozzle 9 jets out picking fluid to pick the weft yarn 2 into the shed 11.

Thus, the drive roller 17 and the driven roller 18 rotate according to the speed control characteristic to pull out the weft yarn 2 positively from the yarn storage drum 6 and feed the weft yarn 2 to the main picking nozzle 9. Accordingly, the main picking nozzle 9 is hardly subjected to resistance in picking the weft yarn 2 into the shed 11 formed by the warp yarns 10.

Upon the reception of a detection signal indicating the delivery of three coils of weft yarn 2 from the yarn storage drum 6 from the sensor 13, the controller 14 drives the electromagnetic actuator 21 so that the driven roller 18 is moved away from the drive roller 17 to stop the positive feed operation of the positive feed mechanism 12. The sensor 13 may be disposed at a position shown in FIG. 1 and the time when three coils of weft yarn have been unwound from the yarn storage drum 6 may be estimated by detecting the time when two and a half coils of weft yarn 2 have been unwound from the yarn storage drum 6 by the sensor 13. A picking terminating period starts at the time when the sensor 13 detects the two and a half unwound coils of weft yarn 2 and the weft yarn 2 is driven for picking only by the picking force of the main picking nozzle 9. Since the operating speed of the servomotor 16, namely, the surface speed of the drive roller 17, has sufficiently been reduced before the positive feed operation is stopped, the weft yarn 2 is not subjected to the sharp variation of yarn tension during the picking terminating period and hence the weft yarn 2 is not broken.

At time when the positive feed operation of the positive feed mechanism is stopped or at time after the positive feed operation of the positive feed mechanism has been stopped, for example, the time by which the three and a half coils of weft yarn 2 are unwound, the controller 14 drives the pin operating device 8 to bring the holding pin 7 into contact with the circumference of the yarn storage drum 6 to check the feed of the weft yarn 2. Accordingly, upon the completion of the unwinding of the four coils of weft yarn 2, the weft yarn 2 is held on the yarn storage drum 6 with the holding pin 7, and then the rotary yarn guide 5 is actuated to wind new coils of weft yarn 2 on the yarn storage drum 6 for the next picking cycle.

According to the present invention, the positive feed mechanism is controlled so as to start its operation at the start of a picking period and to stop its operation before the holding pin 7 holds the weft yarn. Accordingly, a predetermined length of weft yarn can accurately be fed by the yarn measuring and storing device, the frequency of yarn breakage due to the roller's nipping or caused by high tension is reduced, and the efficency of the yarn feed operation of the positive feed mechanism is enhanced.

Modification

A positive feed picking device in accordance with the present invention may employ a sensor 13 for detecting the length of weft yarn inserted in the shed 11, disposed in the shed 11 as indicated by alternate long and two short dashed lines in FIG. 1.

The positive feed mechanism 12 may be provided with a drive roller 17 and a pressing member 24 for pressing the weft yarn 2 against the circumference of the drive roller 17 instead of using the drive roller 17 and the driven roller 18, and the pressing member 24 may be operated directly by an electromagnetic actuator 21.

The positive feed mechanism 12 may be provided with a drive roller and a driven roller kept continuously in contact with the drive roller, and with a means for positively advancing the weft yarn to or positively retracting the weft yarn from the pair of rollers.

What is claimed is:

1. In a positive feed picking device for a fluid jet loom, comprising:

a yarn measuring and storing device for measuring and sorting a weft yarn;

a main picking nozzle for picking the weft yarn; and a positive feed mechanism disposed between the yarn measuring and storing device and the main picking nozzle for feeding the weft yarn positively to the main picking nozzle in a picking cycle;

the improvement comprising:

a sensor disposed at a position on a yarn path along which the weft yarn delivered from the yarn measuring and storing device travels for detecting the delivery of a predetermined length of weft yarn from the yarn measuring and storing device; and a controller for actuating the positive feed mechanism upon the start of a picking period to feed the weft yarn positively to the main picking nozzle, and for stopping the operation of the positive feed mechanism upon the reception of a detection signal provided by the sensor.

2. In a positive feed picking device for measuring and storing a weft yarn;

a main picking nozzle for picking the weft yarn; and a positive feed mechanism disposed between the yarn measuring and storing device and the main picking nozzle for feeding the weft yarn positively in a picking cycle;

the improvement comprising:

a sensor disposed at a position on a yarn path along which the weft yarn delivered from the yarn measuring and storing device travels for detecting the delivery of a predetermined length of weft yarn from the yarn measuring and storing device;

a controller for actuating the positive feed mechanism upon the start of a picking period to feed the weft yarn positively to the main picking nozzle and for stopping the positive feed mechanism upon the reception of a detection signal provided by the sensor upon the detection of delivery of the predetermined length of the weft yarn from the yarn measuring and storing device; and a motor controller for controlling the operation speed of the motor for driving a drive roller of the positive feed mechanism so that the operating speed of the motor varies with the angular position of the main shaft of the fluid jet loom according to a speed control characteristic during the operation of the positive feed mechanism.

3. A positive feed picking device for a fluid jet loom according to claim 2, wherein said speed control characteristic is represented by an upward convex curve on a rectangular coordinate system in which said speed is measured upwardly on the vertical axis and the angular position of the main shaft of the loom is measured to the right on the horizontal axis.

* * * * *